United States Patent [19]

Farrell

[11] Patent Number: 4,966,296

[45] Date of Patent: Oct. 30, 1990

[54] INTEGRATED FOOD TRAY WITH INDIVIDUAL SEPARABLE FOOD CONTAINERS FOR HEATING AND COOLING FOOD

[76] Inventor: Leslie A. Farrell, 9365 N. Perry St., Westminster, Colo. 80030

[21] Appl. No.: 326,922

[22] Filed: Mar. 22, 1989

[51] Int. Cl.[5] ..... A47G 19/32

[52] U.S. Cl. ..... 220/23.4; 220/23.83; 220/23.86; 206/820; 206/608; 206/612; 206/614

[58] Field of Search ..... 206/820; 220/23.4

[56] References Cited

U.S. PATENT DOCUMENTS

| | | | |
|---|---|---|---|
| 3,240,610 | 3/1966 | Cease | 220/23.4 |
| 3,270,909 | 9/1966 | Swartzbaugh et al. | 220/23.4 |
| 3,520,439 | 7/1970 | Smith et al. | 220/23.4 |
| 3,608,770 | 9/1971 | Naimoli | 220/23.4 |
| 3,651,976 | 3/1972 | Chadbourne | 220/23.4 |
| 3,715,856 | 2/1973 | Borel | 206/820 |
| 3,976,196 | 8/1976 | Mueller | 206/820 |
| 3,983,999 | 10/1976 | Morton | 206/820 |
| 4,328,254 | 5/1982 | Waldburger | 220/23.4 |
| 4,339,033 | 7/1982 | Cillario | 220/23.4 |

*Primary Examiner*—Stephen Marcus
*Assistant Examiner*—S. Castellano
*Attorney, Agent, or Firm*—Donald W. Margolis

[57] ABSTRACT

A food serving system in the form of a receptacle housing is provided which is initially integrated, but which includes at least two meal course portion containers which are separable. In such a system at least one separable portion is designed to carry a meal course which is to be heated in that portion, and at least one separable portion is designed to carry a meal course which is not intended to be heated but rather is designed to carry a meal course which is to be served at room temperature or at a temperature cooler than room temperature. In one embodiment the integrated food serving system is in the form of a receptacle housing in which at least one of the separable portions which is designed to carry a meal course has scorelines there-in-between such portion and the receptacle and from other portions carried by the receptacle which are designed to carry meal courses. In another embodiment, the integrated food serving system is in the form of a receptacle housing which includes one or more separable portion which is designed to carry meal course portions in a container which is removably carried by the receptacle housing. In yet another embodiment the integrated food serving system is in the form of a receptacle housing which includes meal course portions which are mechanically connected to the receptacle housing or to one another.

6 Claims, 2 Drawing Sheets

INTEGRATED FOOD TRAY WITH INDIVIDUAL SEPARABLE FOOD CONTAINERS FOR HEATING AND COOLING FOOD

BACKGROUND OF THE INVENTION (a) Field of the Invention

This invention relates to food material, and to products for the packaging and serving of foods for consumer utility. More specifically it relates to a receptacle housing having two or more meal course portions which can be separated from the receptacle housing and be selectively heated and cooled using different types of appliances.

(b) Discussion of the Prior Art

It is well known that a modern day homemaker has a myriad of choices when purchasing food products. For example, in addition to fresh meat and produce and traditional canned goods, there are now a vast selection of frozen foods. The canned goods include packages which include separately canned items that are packaged together, opened, heated and then served together on a dinner plate. The frozen foods include multi-course frozen dinners that are packaged for heating in a conventional oven, or packaged in microwave-safe containers that can be quickly heated in a microwave oven.

U.S. Pat. No. 4,138,014 to Bouman discloses a rupturable package for holding in separable compartments items such as food, drink and tableware. U.S. Pat. No. 2,705,579 to Mason, U.S. Pat. No. 3,185,578 to Scharre, and U.S. Pat. No. 2,776,787 to Nicol describe different types of condiment packaging and tray and can closures. Fontona, et al U.S. Pat. Nos. Des. 297,115; 297,116; 297,117; 297,118; and 297,119, all of which are assigned to Kraft, Inc. disclose, various configurations of compartmented containers, in which there are score lines between the compartments, apparently to allow them to be separated. Review of the files of these Design Patents and of other information from Kraft, Inc. suggests that these compartmented containers are used for refrigerated or frozen items, in which one item is a dairy product course, such as yogurt, and the second item is a topping or a mix-in such as fruit or a flavoring. It is further noted that compartments of such great depth as those depicted in the several Fontana, et al U.S. Patents would not be practical for heating a frozen food item in either a conventional oven or in a microwave oven.

Biggins U.S. Pat. No. 3,381,876 discloses a food container having a housing for inclosing an eating utensil which may be removed from the container after it is opened. Asher U.S. Pat. No. 3,565,245 discloses a combination food container and utensil, in which the utensil is formed as an integral, but removable part of the container. U.S. Pat. No. 3,679,093 to Chang describes a combination food container for holding an implement separately from a food item stored therein.

Besset U.S. Pat. No. 3,381,825 discloses a serving tray which includes a cup-accommodating opening having a number of elongated bendable fingers which fingers yield when a cup is placed in the opening to thereby provide a support for a cup when it is placed in the opening. Thomas U.S. Pat. No. 3,498,470 discloses a serving tray having an integral cup holder which is circular and stepped to provide firm support for a plurality of sizes of tapered cups in the cup receiving holder. It will be noted that with regard to both of these references, cups are utilized or added which are not an integral part of the original packaging, and which include no meal course which was included with the original package.

Sato U.S. Pat. No. Des. 296,871 discloses a container for confectionery (candy) which is multi-layered and segmented.

Other prior art which discloses different types of food packaging and trays are U.S. Pat. No. 3,656,681 to Goings, U.S. Pat. No. 3,704,779 to Nigg, U.S. Pat. No. 3,650,390 to Chung, U.S. Pat. No. 3,429,718 to Helms, and U.S. Pat. No. 2,557,141 to Rebora.

None of these packaged frozen food products are in the form of an integrated food tray which includes a tray housing having a plurality of food containers formed therein for holding separate food items, and having means for separating the food containers from each other so that the food items may be heated and cooled selectively. None of the above-mentioned prior art patents and current methods of food packaging provide, in a single package, an integrated multi-course meal receptacle housing which can be separated into two or more meal course portions, which portions can then be selectively heated and cooled using an appliance which is best suited to the meal course item for which it is used. None of the above-mentioned prior art patents and current methods of food packaging provide a receptacle housing having a variety of different meal course food portion containers which allows such meal course food portion containers to be easily separated and then chosen for heating and cooling prior to serving. None of the above-mentioned prior art patents and current methods of food packaging provide the other unique features and advantages of the subject integrated food tray described herein.

SUMMARY OF THE INVENTION

In view of the foregoing, it is an object of the present invention to provide an integral multi-course meal receptacle housing which can be separated into two more meal course portions, which portions can then be selectively heated and cooled using an appliance which is best suited to the meal course item for which it is used.

It is another object of the present invention to provide an integrated receptacle housing which can then be separated into two or more meal course portions which can be contained in a single package.

Another object of the invention is to provide a receptacle housing having two or more individual meal course portions which can be quickly separated from each other or from the receptacle housing for selectively heating and each meal course portion container prior to serving.

Still another object of the present invention is to provide an integrated receptacle housing in which a variety of different meal course food products can be packaged in a combination which allows such meal course food products to be easily separated and then chosen for heating and cooling prior to serving.

As used herein, the term "receptacle" is used in its conventional dictionary meaning of being something that holds or contains. Similarly, a "housing" is a frame or bracket for holding something. Therefore, a "receptacle housing" is a frame or bracket which holds or contains something, which in this case is a meal course. In some cases a "receptacle housing" may be a frame from which meal course portions are removed, while in other cases it may be a plurality of meal course portions which are initially joined together, but which will ultimately be separated from one another in such a manner that no discernible receptacle housing remains. A "meal course", as used herein, is also used in its conventional dictionary meaning of being a part of a meal which is served as a unit at one time. Thus, a meal course may be a beverage, soup, salad, a main course or the components of a main course which are to be served hot, a main course or the components of a main course which are to be served at room temperature or at colder than room temperature, bread or the like, room temperature desserts, frozen desserts, and the like meal portions. A "meal course", as used herein is not intended to mean or to include eating or serving utensils, or small portions or condiments, such as salt, pepper, ketchup, mustard, soy sauce, salad dressing, horse radish, sour cream, cream, artificial cream, sugar, artificial sweetener, or the like which are intended to be added to a meal course, but which do not constitute a meal course by itself. By example, a main course item is heated in a conventional oven because it has only been partially cooked and most flavorful if cooked to completion in an oven, a dessert item is kept in a freezer because it is best served frozen, and other food items in the meal held at room temperature or quickly heated in a microwave oven just prior to serving.

As further used in this application, a "score-line" is a score, cut, indentation, nick, notch, slit, perforation or the like in a portion of the receptacle housing which allows a separable portion which is initially an integral portion of a receptacle housing to be easily completely separated from the housing or from other separable portions.

The present invention relates to a food serving system in the form of a receptacle housing which is initially integrated, but which includes at least two meal course portions which are separable one from another or from the receptacle housing. In such a system at least one portion is designed to carry a meal course which is to be heated in that portion, and at least one portion which is not intended to carry a meal course which is not to be heated in that portion, but rather is designed to carry a meal course which is to be served at room temperature or at a temperature cooler than room temperature. Either or both portions which are designed to carry a meal course, and other meal course portions are or may be separable from the receptacle housing or from one another for separate heating, separate cooling, or for maintenance at ambient temperature as desired or required before they are served as a meal course. In one preferred embodiment of the invention the integrated food serving system is in the form of a receptacle housing having a plurality of meal course container portions for holding separate meal courses, and which have score lines between one or more of the meal course container portions and the rest of the receptacle. Such score-lines provide for ease of separation of such meal course container portions from the receptacle and/or from other separable meal course container portions carried by the receptacle. In another preferred embodiment of the present invention the integrated food serving system is in the form of a receptacle housing in which one or more separable portions which are designed to carry meal courses are in the form of a container removably carried by the receptacle housing. In order to provide these functions, each separable portion or container is constructed of any art known material or material which is developed in the future which is designed to be compatible with being heated in a microwave oven or other conventional heating systems or which is designed to be compatible with being maintained at room temperature or in a freezer or refrigerator.

In one preferred embodiment of the invention the integrated food tray for heating and cooling separate food items includes a tray housing having a plurality of food containers formed therein for holding separate food items. In this embodiment the food tray housing have means, such as tear lines for separating the food containers from each other. Each food container is made of a chosen material designed for compatible use in a freezer, refrigerator, microwave oven, and/or conventional oven.

In yet another embodiment of the present invention the integrated food serving system is in the form of a receptacle housing in which separable portions have been place side-by-side, and mechanically connected, for example, by the use of an adhesive tape which overlaps a portion of two adjacent separable portions. Another form of mechanical connection would be to have side-by-side, adjacent meal course container portions carry interactive mechanical locking elements, such as snaps carried by one portion and holes or tabs carried by another portion. Any such art known or subsequently developed mechanical connecting means can be utilized to make such a mechanical connection, within the meaning of the present invention.

These and other object of the present invention will become apparent to those skilled in the art from the following detailed description, showing the contemplated novel construction, combination and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENT

Figure 1:
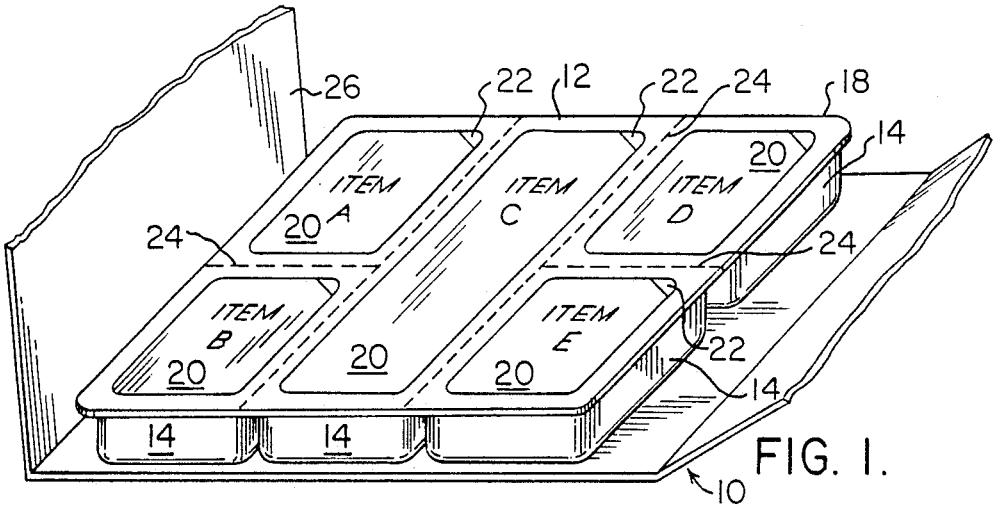
FIG. 1 is a perspective view of one form of the integrated food tray with separable meal-course containers of the present invention, shown in an open, broken away package.
Figure 2:
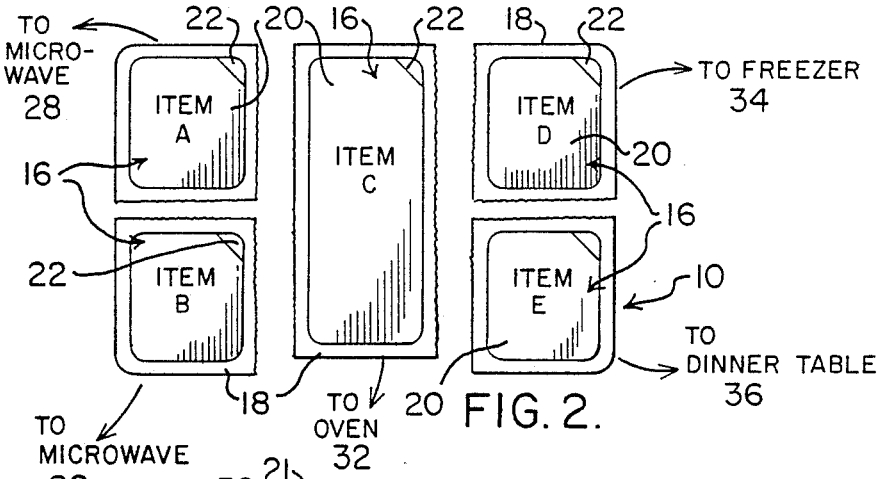
FIG. 2 is a slightly reduced top view of the integrated food tray of FIG. 1 with the separable meal-course containers shown separated from one another.

In the several embodiments shown, like reference numbers or letters are used to designate like portions in the several embodiments. Referring first to FIGS. 1 and 2, the subject integrated food tray is designated, general, by reference numeral 10. The food tray 10 includes a tray housing 12 which includes a plurality of recesses 14 formed therein. As set forth in greater detail below, each recess 14 can be separated from one another, and is of a size which allows it to be used as an individual meal-course food container. When they are separated from one another they can be used as individual meal-course food containers 16, as shown in FIG. 2. Tray housing 12 has a flange 18 around its outer edges, portions of which are integral with the tops of some of the recesses 14. Flanges 18 forms an upper frame and circumference for food tray 10. In this embodiment, when a meal course portion has been properly placed in each recess 14, a sealed cover 20 having a pull tab 22 is then secured thereover to provide an appropriate seal.

Score lines 24 are carried by food tray 10 between the various recesses 14. Score lines 24 are of such a character that recesses 14 and the meal course which they carry can be quickly and easily separated into a plurality of containers 16 which each carry a meal portion. In practice, food tray 10 is shipped and stored using a surrounding package 26, shown open and broken away in FIG. 1.

Each of the individual containers 16 contain a different food meal portion item, herein designated A, B, C, D, and E. For example, item A may be a soup portion , item B may be a vegetable portion such as green beans, peas, carrots; item C may be a precooked or partially cooked main course portion such as turkey and stuffing, diced chicken, or ground beef with gravy. Item D may be any frozen dessert portion such as ice cream or sherbet, and Item E may be a meal portion which is intended to be served at ambient temperature, such as a salad or dinner roll. It should be mentioned that the above food items are only a small selection of a variety of different foods that, in this example, can make up a wholesome, well-balanced, five course dinner for people of different tastes and ages.

In practice, food tray 10 in closed package 26 would be held in a freezer or refrigerated area of or shelf stable storage, depending on the type of food sealed in the containers 16, or the process by which it was prepared for storage.

In FIG. 2 the food containers 16 have been separated from each other along the score lines 24 which are shown in FIG. 1. Arrows 28 indicate that meal portions A and B are to be removed to a microwave oven in which the meal portions can quickly be heated prior to serving. Item C has an arrow 32 which indicates it has a meal portion that it is best slowly heated in a conventional oven prior to serving. Arrow 34 shows that the meal portion carried as item D needs to be frozen or to remain frozen in a freezer prior to being eaten. The last, item E, has an arrow 36 which indicates that this meal portion will be placed on a dinner table and served at normal room temperature.

In order to accomplish this the container 16 holding Item C may be made of lightweight metal foil, for example. The meal portion items placed in A and B can be placed in containers 50 which are made, for example, of a non-metal microwave safe material such as plastic or laminated paperboard, or of any other material of the type which is microwave safe and will allow the quick heating of these containers and their meal portion items in a microwave oven. The containers 16 with sealed covers 21 holding meal portion items D and E which are used in a freezer, refrigerator, or at room temperature can be made of a variety of materials as long as they are compatible with the meal portion received therein.

Figure 3:
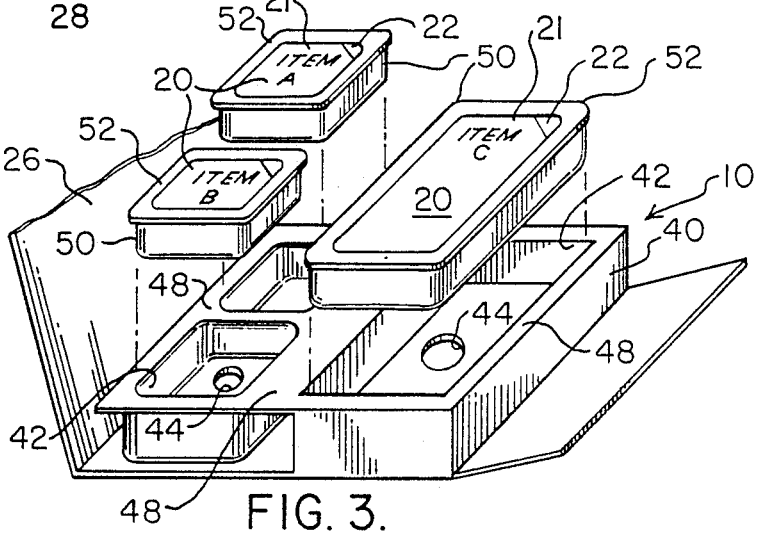
FIG. 3 is an exploded perspective view of an alternate embodiment of the integrated food tray with separable meal-course containers of the present invention.

Referring now to FIG. 3 an alternate embodiment of the integrated food try 10 is illustrated. The food tray 10 in this example uses a drop-in/pop-out carrier 40 having recesses 42 formed therein. It is shown to include finger holes 44 centered in the bottom of the recesses 42, for use as explained below. The upper surface of carrier 40 forms flanges or frames 48 which surround the individual recesses 42. Containers 50 carry flanges 52 around their tops, which flanges 52 rest on frame 48 when containers 50 are located in recesses 42.

In the embodiment shown in FIG. 3, carrier 40 is shown with three individual and separate meal portion recesses 42 from which meal portion containers 50 are shown in exploded view as if they had been removed from carrier 40. Such removal is facilitated by inserting a finger or other item through finger holes 44. Alternatively, containers 50 can be removed by grasping flanges 52 surrounding the top of each meal portion container 50 and lifting them from the carrier 40.

As shown in the FIG. 3, containers 50 include meal portion items A, B, and C. Each of the meal portion items may be secured in its individual container 50 using an air tight sealed cover 20 with a pull tab 22 used for removing each cover 20.

Prior to shipping and storage of the food tray 10 the individual containers 50 are dropped into the recesses 42 of the carrier 40. The carrier 40 is then placed in package 26. After the food tray 10 has been purchased and taken home for a meal preparation, package 26 is opened, and meal portion items A, B, and C are removed as discussed above. Because the individual separable meal portion containers 50 are designed for being heated or cooled using different kitchen appliances.

Figure 4:
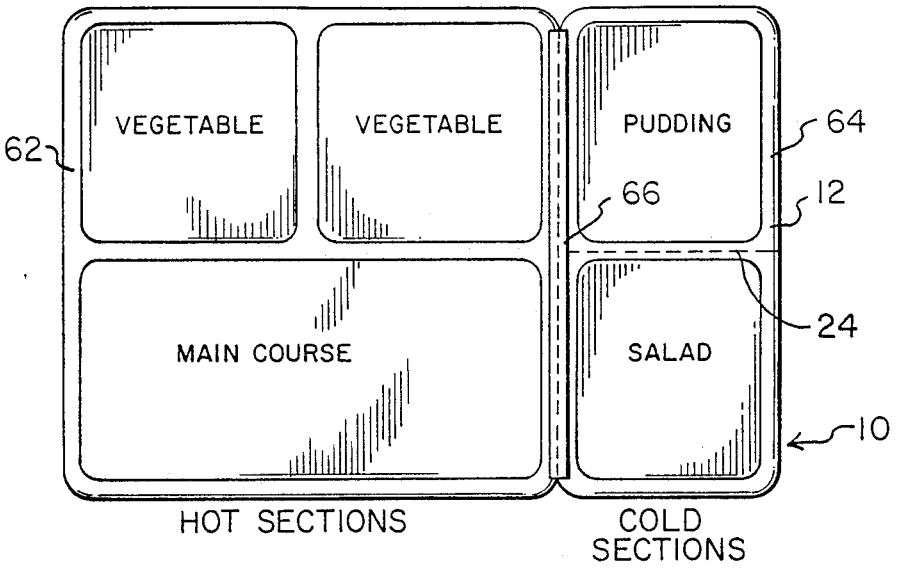
FIGS. 4 and 5 are top and side views, respectively, of yet another alternate embodiment of the integrated receptacle housing with separable meal-course containers, and in which an adhesive type of tape is utilized to join separable meal course container portions.
Figure 5:
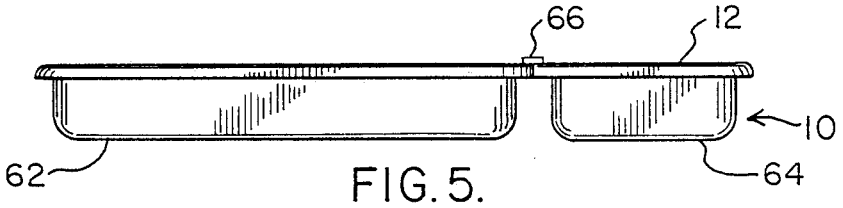

Referring to FIGS. 4 and 5, yet another embodiment of the present invention is illustrated. In this embodiment the integrated food serving system 10 is in the form of a receptacle housing 12 which is composed of two separable portions 62 and 64. Separable portions 62 and 64 are located side-by-side, and mechanically connected by the use of an adhesive tape strip 66 which overlaps a top flange portion of the two adjacent separable portions 62 and 64. The meal course portions in this embodiment are similar to those discussed above with respect to FIGS. 1, 2 and 3, for example, a main course portion and two vegetable course portions, all of which are intended to be heated are included in portion 62, while portion 64 includes a dessert and a salad. The dessert and salad can either be refrigerated together or separated at score line 24.

Figure 6:
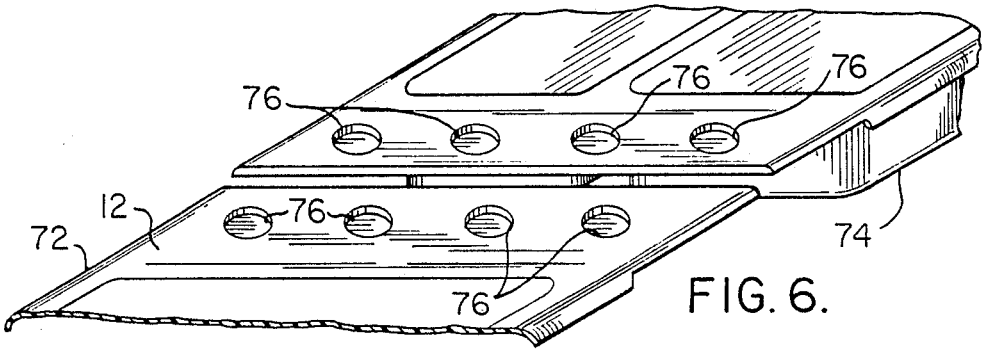
FIGS. 6 and 7 are top and side views, respectively, of still yet another alternate embodiment of the integrated receptacle housing with separable meal-course containers, and in which an mechanical connectors, such as snaps and holes are utilized to join separable meal course container portions.
Figure 7:
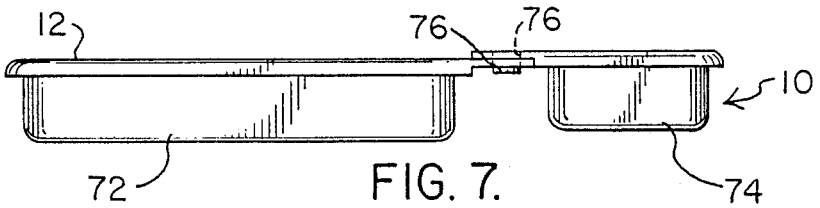

In FIGS. 6 and 7 yet another system for mechanically connecting adjacent meal course container portions is shown. In this embodiment the integrated food serving system 10 is in the form of a receptacle housing 12 in which two separable portions 72 and 74 are located adjacent to one another, in this case side-by-side, and mechanically connected. The separable portions 72 and 74 carry interactive mechanical locking elements, in this case snaps 76. The meal course portions in this embodiment may be similar, for example, to those discussed above with respect to FIGS. 1–5.

Any other art known or subsequently developed mechanical means for connecting separable portions can be utilized to make a mechanical connection, within the meaning of the present invention.

It is therefore seen that the present invention provides, an integrated food tray which includes a tray housing having a plurality of food containers formed therein for holding separate food items, and having means for separating the food containers from each other so that the food items may be heated and cooled selectively. Additionally, the present invention provides, in a single package, an integrated multi-course meal receptacle housing which can be separated into two or more meal course portions, which portions can then be selectively heated and cooled using an appliance which is best suited to the meal course item for which it is used. Furthermore, it is clear that the present invention provides, a receptacle housing having a variety of different meal course food portion containers which allows such meal course food portion containers to be easily separated and then chosen for heating and cooling prior to serving.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

I claim:

1. An integrated food receptacle for heating and cooling, or for maintaining at ambient condition, separate meal course portions, said food receptacle comprising:

a receptacle housing;

at least two meal course portion containers integrally connected to said receptacle housing, wherein at least one of said meal course portion containers is composed of heat resistant material selected from the group consisting of microwave-safe material and conventional oven safe and compatible material, and wherein further t least one of said meal course portion containers is composed of material selected from the group consisting of freezer, refrigerator, and ambient temperature safe and compatible material; and means for releasing at least one of said integrally connected meal course portion containers from said receptacle housing, and as necessary from each other meal course portion container; whereby each said separate released meal course portion container may be heated, or cooled, or maintained at ambient conditions, as desired.

2. The food receptacle of claim 1 wherein said releasing means is a score-line.

3. The food receptacle of claim 1 wherein said at least two meal course portion containers are substantially adjacent to one another, and wherein further there are means for connecting and allowing separation of said substantially adjacent meal course portion containers from one another.

4. The food receptacle of claim 3 wherein said means for allowing separation of said meal course portion containers from one another is a score-line.

5. The food receptacle of claim 1 further including sealed covers attached to the top of each of said meal course portion containers for providing a seal for any meal course carried therein.

6. The food receptacle of claim 1 wherein said releasing means is incorporated in said receptacle housing.

* * * * *